US009522321B2

(12) United States Patent
Cummings

(10) Patent No.: US 9,522,321 B2
(45) Date of Patent: Dec. 20, 2016

(54) TOY BOW AND ARROW SYSTEM WITH INTERNAL BOW LIGHTING

(71) Applicant: Peter Cummings, Kowloon (HK)

(72) Inventor: Peter Cummings, Kowloon (HK)

(73) Assignee: KMA Concepts Limited, Tsim Sha Tsui, Kowloon (HK)

( * ) Notice: Subject to any disclaimer, the term of this patent is extended or adjusted under 35 U.S.C. 154(b) by 161 days.

(21) Appl. No.: 14/016,164

(22) Filed: Sep. 2, 2013

(65) Prior Publication Data

US 2014/0000577 A1 Jan. 2, 2014

Related U.S. Application Data

(63) Continuation-in-part of application No. 13/902,968, filed on May 27, 2013, which is a continuation-in-part of application No. 12/878,985, filed on Sep. 9, 2010, now Pat. No. 8,662,060.

(51) Int. Cl.

| | |
|---|---|
| ***F41B 3/02*** | (2006.01) |
| ***A63F 9/02*** | (2006.01) |
| ***F41B 5/00*** | (2006.01) |
| ***F41B 5/14*** | (2006.01) |
| ***F41B 7/08*** | (2006.01) |
| ***F41B 3/00*** | (2006.01) |

(52) U.S. Cl.

CPC ..... *A63F 9/0252* (2013.01); *F41B 3/00* (2013.01); *F41B 5/0094* (2013.01); *F41B 5/1484* (2013.01); *F41B 7/08* (2013.01)

(58) Field of Classification Search

CPC ..... F41B 5/0094; F41B 3/00; A63F 9/0252; F41G 1/35

USPC ..... 124/20.1, 22, 17, 23.1

See application file for complete search history.

(56) References Cited

U.S. PATENT DOCUMENTS

| | | | | |
|---|---|---|---|---|
| 4,671,249 | A * | 6/1987 | Troncoso | 124/23.1 |
| 4,697,228 | A | 9/1987 | Mui et al. | |
| 5,072,715 | A * | 12/1991 | Barr | 124/20.1 |
| 5,247,920 | A | 9/1993 | Harbin | |
| 5,279,513 | A | 1/1994 | Connelly | |
| 5,415,151 | A * | 5/1995 | Fusi et al. | 124/56 |
| 7,748,369 | B2 | 7/2010 | Chee | |
| 7,766,721 | B2 * | 8/2010 | Ma | A63H 33/009 446/473 |
| 2006/0011189 | A1 * | 1/2006 | Simo et al. | 124/86 |

OTHER PUBLICATIONS https://web.archive.org/web/20100211000220/http://www.doubletakearchery.com/bowplane.htm.*

* cited by examiner

*Primary Examiner* — Melba Bumgarner

*Assistant Examiner* — Amir Klayman

(74) *Attorney, Agent, or Firm* — LaMorte & Associates, P.C.

(57) ABSTRACT

A toy bow assembly that is used to launch toy projectiles. The toy bow assembly includes a bow structure having a first arm section and a second arm section. Both the first arm section and the second arm section contain at least one translucent area. Lights are disposed within both the first arm section and the second arm section. The lights internally illuminate the translucent areas of the first arm section and second arm section when activated. An activation switch is disposed on the bow structure for selectively activating and deactivating the lights.

16 Claims, 4 Drawing Sheets

TOY BOW AND ARROW SYSTEM WITH INTERNAL BOW LIGHTING

RELATED APPLICATIONS

This application is a continuation-in-part of co-pending U.S. patent application Ser. No. 13/902,968 filed May 27, 2013, which is a continuation-in-part of U.S. patent application Ser. No. 12/878,985, filed Sep. 9, 2010.

BACKGROUND OF THE INVENTION

1. Field of the Invention

In general, the present invention relates to toy bow and arrow systems, where a toy bow is used to launch a toy arrow projectile into flight.

2. Prior Art Description

Bow and arrow sets that are designed for children's play have existed throughout recorded history. In the modern era, toy bow and arrow sets typically have a plastic molded bow, a string and safety-tipped arrows. To ensure safety, the functional design of a toy bow is also commonly altered. In a real bow, the string has a fixed length. The spring force used to launch an arrow comes from the flexing of the arms of the bow. The problem with this design is its failure mode. If a bow is drawn beyond its limit, then the arms or the string of the bow may break. Depending upon where the breakage occurs, the broken string and/or bow may fly toward the person holding the bow as the stored energy is accidentally released.

To reduce the likelihood of this hazard from occurring, many toy bows are manufactured as static structures. An elastic string is used to create the arrow launching force. If such a bow is overdrawn, there is no significant chance of the bow breaking. Rather, the elastic string will break and will most likely move in a direction away from the person drawing the bow. The failure mode of a string breaking is far less dangerous than the failure mode of the bow breaking. However, the failure mode of a broken string does present some danger depending upon where the elastic string breaks and how much energy is stored in the elastic string at the time it breaks.

Toy bows that use a static bow and an elastic string are exemplified by U.S. Pat. No. 5,247,920 to Harbin, entitled Toy Bow; and U.S. Pat. No. 7,748,369 to Chee, entitled Launching Apparatus and Assembly.

Many toy bows that have elastic strings use elastic strings that are made from a synthetic polymer, such as silicon, TPR or some other synthetic rubber. On the toy, such elastic strings are constantly under tension. As such, if the material of the string creeps or degrades, the elastic string will break. This stops the toy bow from being functional.

Most all plastic degrades in some fashion over time. However, it has been found that one of the fastest ways to degrade the preferred polymers used for the bowstring is to expose the bowstring to UV light. A bowstring that can last for months inside a home may only last for a few days if taken outside and left in sunlight. A toy that lasts for months is acceptable. A toy that last for days is not. Damage caused by exposure to light has therefore caused products to be returned and/or consumer's dissatisfaction with the toy manufacturer.

In co-pending U.S. application Ser. No. 13/909,968, the applicant presents a toy bow where the elastic bowstring is encased and protected from UV light in the ambient atmosphere. However, in shielding the bowstring the toy bow loses some aesthetics. However, the shielding over the bowstring provides an opportunity to provide unique improved aesthetics through the use of internal lighting.

A need therefore exists for a toy bow and arrow design that inhibits degradation in the elastic string caused by exposure to UV light, yet provides enhanced aesthetics using internal lighting that does not contain significant UV wavelengths. This need is met by the present invention as described and claimed below.

SUMMARY OF THE INVENTION

The present invention is a toy bow assembly that is used to launch toy projectiles. The toy bow assembly includes a bow structure having a first arm section and a second arm section. Both the first arm section and the second arm section contain at least one translucent area.

Lights are disposed within both the first arm section and the second arm section. The lights internally illuminate the translucent areas of the first arm section and second arm section when activated.

An activation switch is disposed on the bow structure for selectively activating and deactivating the lights.

A first elastic element is anchored to the first arm section. The first elastic element extends through the first arm section into a central area. The first arm section shields the first elastic element from exposure to ambient light. Likewise, a second elastic element is anchored to the second arm section. The second elastic element extends through the second arm section and into the central area. The second arm section shields the second elastic element from exposure to ambient light. This prevents the elastic elements from degrading due to exposure of UV light contained in ambient light.

A toy projectile is provided that has extending hooks. The hooks on the projectile engage the elastic elements. When the projectile is drawn back, the elastic elements stretch and provide the spring energy needed to launch the projectile into flight when it is released.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention toy bow and arrow system can be embodied in many ways, only one exemplary embodiment of the present invention system is illustrated. This embodiment is selected in order to set forth the best mode contemplated for the invention. The illustrated embodiment, however, is merely exemplary and should not be considered a limitation when interpreting the scope of the appended claims.

Figure 1:
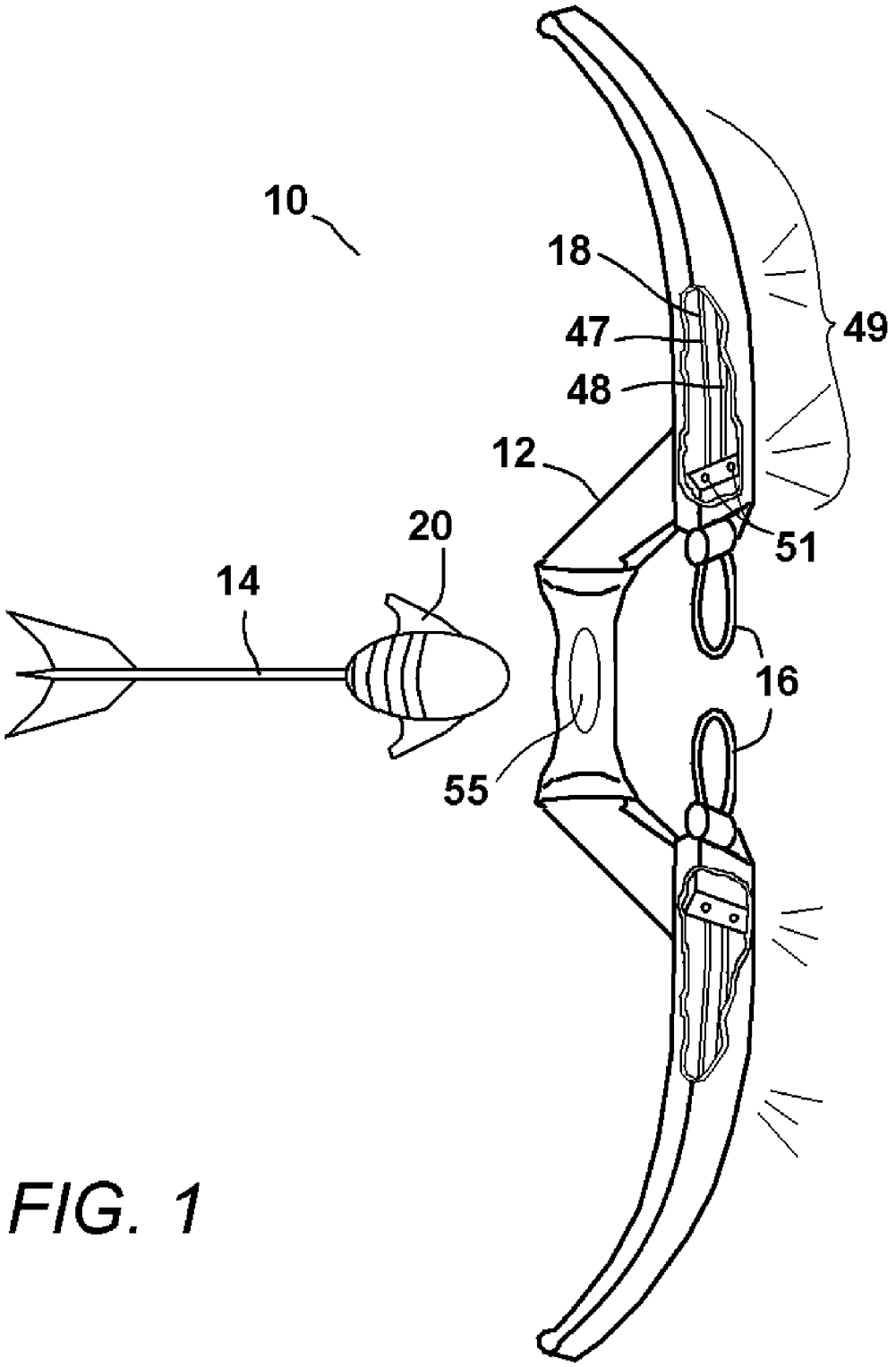
FIG. 1 is a perspective view of an exemplary embodiment of a toy bow and toy projectile in combination.

Referring to FIG. 1, a bow and arrow system 10 is shown. The bow and arrow system 10 includes a bow structure 12 and at least one arrow projectile 14. The bow structure 12 is rigid. The force used to propel the arrow projectile 14 is provided by two separate and distinct loading loops 16. The arrow projectile 14 has hook projections 20 that engage both of the loading loops 16. Elastic elements 18 extend through the loading loops 16. As a person engages an arrow projectile 14 with the loading loops 16 and pulls on the arrow projectile 14, the elastic elements 18 in the loading loops 16 stretch. Since there are two loading loops 16, the elastic element 18 in each of the loading loops 16 need only provide half the force needed to propel the arrow projectile 14 into flight. The elastic elements 18 are therefore difficult to overstretch in the proper operation of the toy. Furthermore, should either of the elastic elements 18 or loading loops 16 suddenly break, the orientation of the broken elastic elements 18 prevents the elastic elements 18 or the loading loops 16 from whipping toward the user. This dynamic is explained later in greater detail. Lastly, since the arrow projectile 14 engages two separate and distinct loading loops 16, the chances of the elastic elements 18 in both loading loops 16 breaking simultaneously are highly improbable. Accordingly, if one elastic element 18 breaks, the arrow projectile 14 will still be engaged by the other loading loop 16 and the person pulling the arrow projectile 14 back will not pull the arrow projectile 14 into himself upon the breakage of the one loading loop 16.

Figure 2:
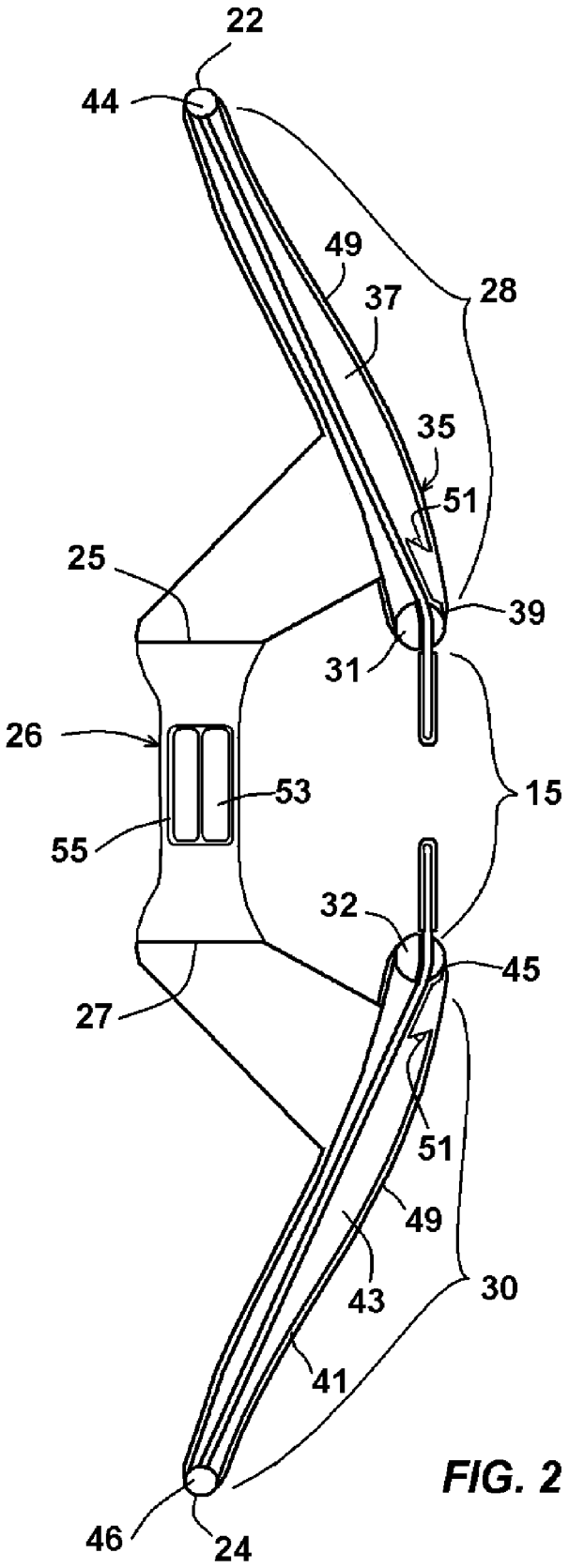
FIG. 2 is a side cross-sectional view of the toy bow shown in FIG. 1.

Referring to FIG. 2 in conjunction with FIG. 1, it can be seen that the bow structure 12 is a rigid molding. The bow structure 12 has a first end 22, a second end 24 and a handle 26 in its central region. The handle 26 has a top end 25 and a bottom end 27. A first arm section 28 is supported above the top end 25 of the handle 26. Likewise, a second arm section 30 is supported below the bottom end 27 of the handle 26. The first arm section 28 and the second arm section 30 are oriented in a common vertical plane. The handle 26 is offset from the common vertical plane so as not to interfere with the path of the arrow projectile 14. This creates an open central region 15 between the first and second arm sections 28, 30 that is defined by the handle 26.

The first arm section 28 contains a sheath structure 35 that defines a first internal compartment 37. The first internal compartment 37 has a bottom end 39 that faces toward the open central region 15. Likewise, the second arm section 30 contains a sheath structure 41 that defines a second internal compartment 43. The second internal compartment 43 is has a top end 45 that faces toward the open central region 15. Both sheath structures 35, 41 have forward-facing surfaces 49 that are translucent.

One or more light emitting diodes 51 are mounted inside each of the sheath structures 35, 41. When the light emitting diodes 51 activate, they internally illuminate both the first internal compartment 37 and the second internal compartment 43. This internal illumination can be viewed from an external point through the translucent areas 49 on both sheath structures 35, 41. Although only one or a few light emitting diodes 51 may be used in each of the internal compartments 37, 43, the internal illumination causes the translucent areas 49 to glow brightly wherever they are backlit by the internal illumination.

The light emitting diodes 51 are preferably monochromatic and emit light between the green and red wavelengths of the visible spectrum. Such light contains no significant ultraviolet components. The light produced by the light emitting diodes 51, therefore, produces no significant degradation in the polymers of the elastic elements 18. As such, the light emitting diodes 51 can emit bright light without adversely affecting the lifespan of the elastic elements 18.

The light emitting diodes 51 are powered by batteries 53. The batteries 53 are contained within a battery compartment 55 that is manufactured into the bow structure 12. Although a batter compartment can be positioned within in the first arm section 28 or the second arm section 30, it is preferred that the battery compartment 55 be placed within the structure of the handle 26.

When using the bow and arrow system 10, a person grasps the handle 26 of the bow structure 12. As such, it is preferred that an on/off switch 55 be positioned on the handle 26 in a position that can easily be operated by a person grasping the handle 26 of the bow structure 12. In the preferred embodiment, the on/off switch 55 is a normally "off" switch that turns "on" only when actively pressed. The on/off switch 55 can be integrated into the handle 55 so that the on/off switch is activated merely by firmly grasping the handle 26 of the bow structure 12.

Figure 3:
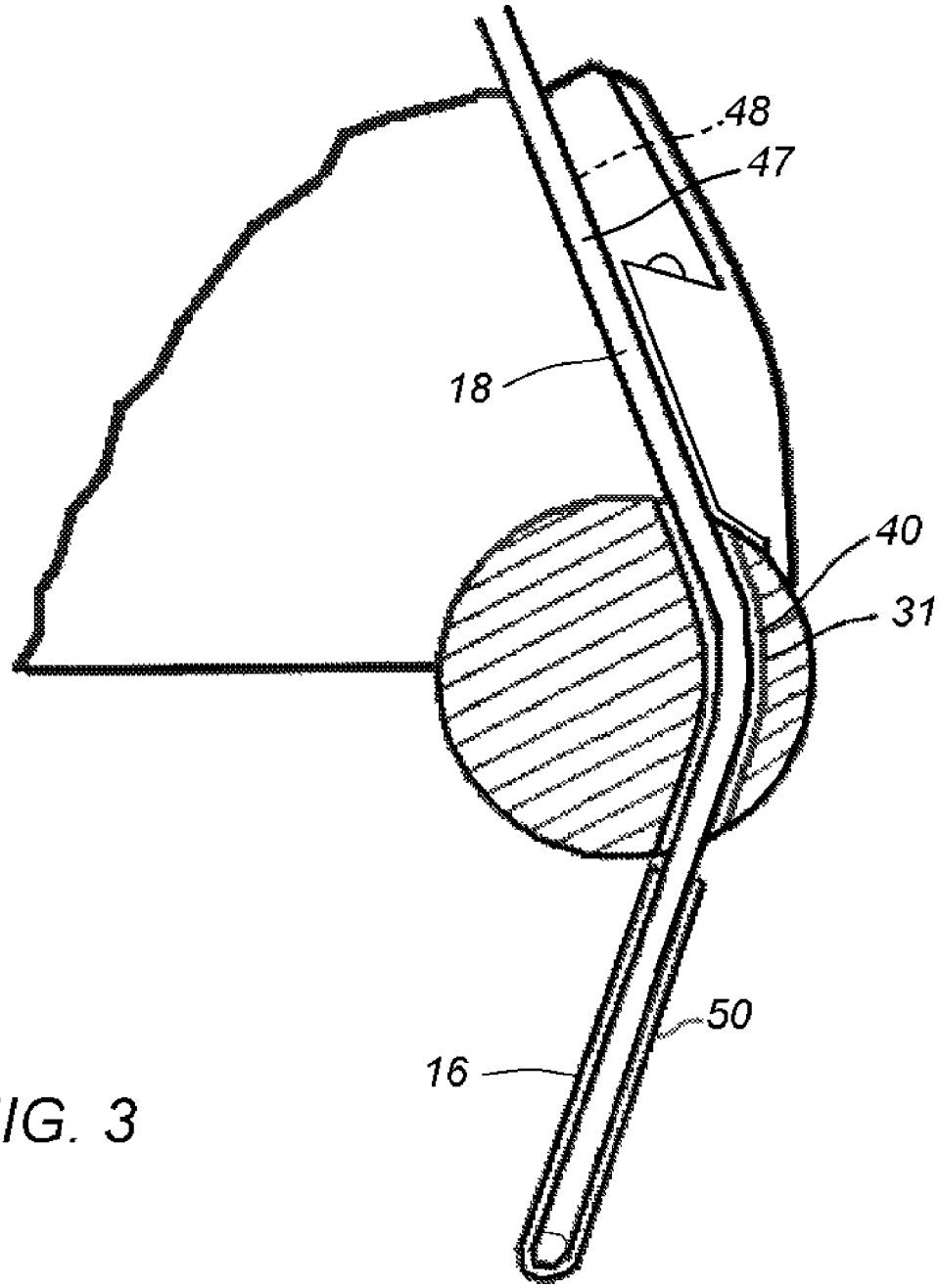
FIG. 3 is a cross-sectional view of a pivot post shown in section 3 of FIG. 2.

Two post structures 31, 32 are mounted to the bow structure 12 outside the bottom opening 39 of the first sheath structure 35 and the top opening 45 of the bottom sheath structure 41. Referring now to FIG. 2 in conjunction with FIG. 3, it will be understood that although FIG. 3 shows only one of the post structures 31, the description offered stands for both post structures 31, 32 equally. Each pivot post structure 31, 32 defines two narrow channels 40. In FIG. 3, only one channel 40 is shown. It will be understood that a second channel lay below the shown channel 40 in a parallel configuration.

Each of the loading loops 16 is a loop structure of an elastic element 18 that creates two runs 47, 48. The runs 47, 48 of each elastic element 18 extend through the sheath structures 35, 41 and through the two pivot posts 31, 32. Each elastic element 18 has two ends. Both ends of each elastic loop 18 are affixed to anchored posts 44, 46 within the sheath structure 35, 41. Since the runs 47, 48 of each elastic element 18 extend through the sheath structures 35, 41, it will be understood that the material of the elastic elements 18 is shielded from any external light exposure until the elastic elements 18 are stretched out of the channels 40 in the pivot post structures 31, 32.

The length of the elastic element 18 has a cross section that is smaller than the diameter of the channels 40 in the pivot post structures 31, 32. In this manner, a separate run 47, 48 of the elastomeric element 18 can pass through each of the openings 40, therein keeping the two runs 47, 48 of the loop apart.

As the runs 47, 48 of the elastic element 18 pass out of the pivot post structures 31, 32, the elastic element 18 immediately passes into reinforcement tubes 50 to form the loading loops 16. The diameters of the reinforcement tubes 50 are larger than the channels 40 in the pivot post structures 31, 32. Consequently, the reinforcement tubes 50 cannot pass through the pivot post structures 31, 32. As a result, each length of the elastic element 18 is divided into two runs 47, 48. The first run 47 extends between an anchor post and the reinforcement tube 50 on the far side of the pivot post structure. The second run 48 extends from the reinforcement tube 50 back to the anchor post. The looping of the elastic element 18 between the two runs 47, 48 curves the reinforcement tubes 50 and creates the two loading loops 16.

Additionally, the presence of the reinforcement tubes 50 protects the elastic element 18 inside the loading loops 16 from exposure to external light. Consequently, when the elastic elements 18 are at rest, the entire length of each of the elastic elements 18 is shielded from external ambient light.

Due to the offset of the handle 26, an open central region 15 exists between the two pivot post structures 31, 32. The loading loops 16 each extend into the open central region 15 from opposite sides.

Figure 4:
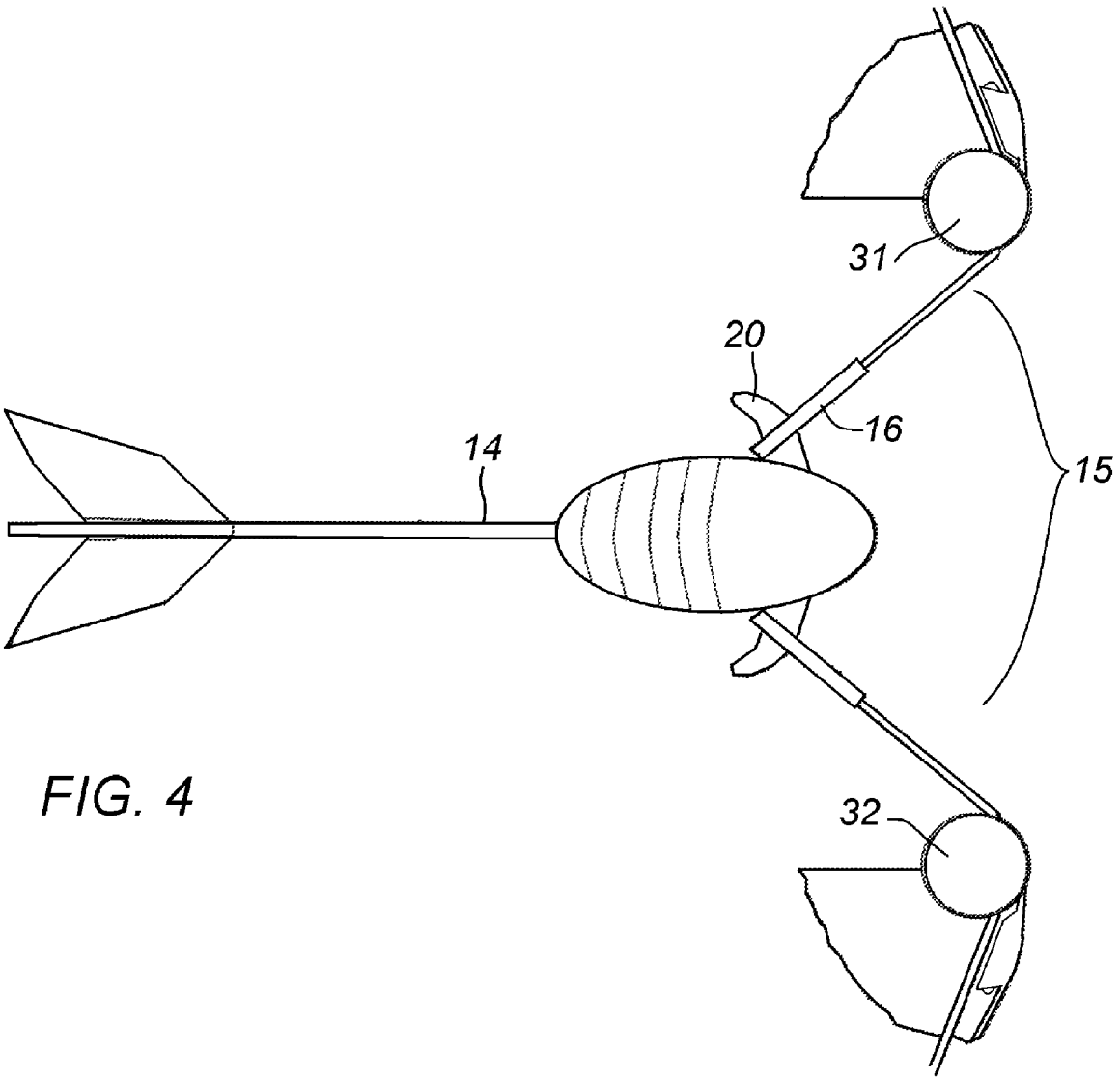
FIG. 4 shows a toy projectile engaging the loading loops within the central region of the toy bow.

Referring to FIG. 4 in conjunction with FIG. 1, it can be seen that the arrow projectile 14 has two hook elements 20 extending from opposite sides. The hook elements 20 are sized and shaped to engage the two loading loops 16 as the hook elements 20 are pulled through the open central region 15. To load the arrow projectile 14, the arrow projectile 14 is positioned within the open central region 15 so that the hook elements 20 engage the loading loops 16. Once engaged with the loading loops 16, the arrow projectile 14 is pulled in the manner of a traditional bow and arrow. As the arrow projectile 14 is pulled away from the open central region 15, the elastic elements 18 stretch. The elastic elements 18 bend around the pivot post structures 31, 32, therein enabling the loading loops 16 to move with the arrow projectile 14. This is the only time that parts of the elastic elements 18 are exposed to ambient light. This exposure lasts only for as long as the elastic elements 18 are stretched. Thus, the exposure to ambient light only lasts for a few seconds during each shot cycle.

As the elastic elements 18 stretch, they store energy. When the arrow projectile 14 is released, the elastic elements 18 retract and the arrow projectile 14 is accelerated toward the open central region 15. At the open central region 15, the loading loops 16 retract against the pivot post structures 31, 32. The momentum of the arrow projectile 14 causes the arrow projectile 14 to continue its forward movement beyond the open central region 15. This launches the arrow projectile 14 into flight as the hook elements 20 disengage the loading loops 16.

When the elastic elements 18 are stretched, they are most vulnerable to breakage. If one of the runs 47, 48 of an elastic element 18 breaks before passing through a pivot post structure 31, 32, then the speed of the contracting broken elastic element 18 is slowed by its passage through the pivot post structure 31, 32. This prevents a broken run from whipping toward a user. Furthermore, if the elastic element 18 were to break after it passes the pivot post structure 31, 32, most of the potential energy serves to move the broken elastic element 18 back toward the pivot post structure 31, 32 and away from the user.

It will be understood that the embodiment of the present invention that is illustrated and described is merely exemplary and that a person skilled in the art can make many variations to that embodiment. For instance, the bow structure can have many different ornamental shapes. The bow structure can also take the form of a crossbow. Likewise, the arrow projectiles can be configured as airplanes, rocket ships or any other flying projectile. All such embodiments are intended to be included within the scope of the present invention as defined by the claims.

What is claimed is:

1. A toy bow assembly used to launch toy projectiles, said toy bow assembly comprising:

a bow structure having a handle, a first arm section and a second arm section, wherein said first arm section and said second arm section both contain internal compartments, wherein each of said internal compartments is defined, in part, by at least one translucent area;

lights disposed within said internal compartments of both said first arm section and said second arm section, wherein said lights internally illuminate each of said internal compartments when activated, wherein light from said lights is observable through said at least one translucent area of each internal compartment;

an activation switch disposed on said bow structure for selectively activating and deactivating said lights;

a first elastic loop that is anchored to said first arm section, wherein said first elastic loop extends through at least part of said first protected area and into said open central region from said first arm section; and a second elastic loop that is anchored to said second arm section, wherein said second elastic loop extends through at least part of said second protected area and into said open central region from said second arm section, wherein said first elastic loop and said second elastic loop are separated by a gap within said open central region.

2. The assembly according to claim 1, wherein said activation switch is disposed on said handle.

3. The assembly according to claim 1, further including a battery compartment disposed within said bow structure for holding batteries to power said lights.

4. The assembly according to claim 3, wherein said battery compartment is disposed within said handle.

5. The assembly according to claim 1, further including a first reinforcement tube that surrounds said first elastic loop in said central area, therein shielding said first elastic loop from exposure to ambient light in said central area.

6. The assembly according to claim 5, further including a second reinforcement tube that surrounds said second elastic loop in said central area, therein shielding said second elastic loop from exposure to ambient light in said central area.

7. The assembly according to claim 1, further including a first post structure and a second post structure located proximate said central region on opposite sides of said central region.

8. The assembly according to claim 7, wherein said first elastic loop is formed by a first elastic element that is coupled to a first anchor point on said first arm section, wherein said first elastic element extends from said first anchor point to said first elastic loop, and wherein said first elastic element bends about said first post structure between said first anchor point and said first elastic loop.

9. The assembly according to claim 8, further including a first channel at said first post structure through which said first elastic element passes.

10. A toy launching assembly used to launch toy projectiles, said assembly comprising:

a first arm section and a second arm section that are joined together by an offset handle, wherein an open central region is defined by said handle between said first arm section and said second arm section;

a first translucent area disposed on said first arm section, wherein a first protected area is defined within said first arm section under said first translucent area;

a second translucent area disposed on said second arm section, wherein a second protected area is defined within said second arm section under said second translucent area;

lights disposed within both said first protected area and said second protected area, wherein said lights internally illuminate said first translucent area and said second translucent area when activated;

a first elastic loop that is anchored to said first arm section, wherein said first elastic loop extends through at least part of said first protected area and into said open central region from said first arm section; and a second elastic loop that is anchored to said second arm section, wherein said second elastic loop extends through at least part of said second protected area and into said open central region from said second arm section, wherein said first elastic loop and said second elastic loop are separated by a gap within said open central region.

11. The assembly according to claim 10, further including an activation switch disposed on said bow structure for selectively activating and deactivating said lights.

12. The assembly according to claim 11, wherein said activation switch is disposed on said handle.

13. The assembly according to claim 10, further including a battery compartment disposed within said bow structure for holding batteries to power said lights.

14. The assembly according to claim 13, wherein said battery compartment is disposed within said handle.

15. The assembly according to claim 10, further including a first post structure and a second post structure located proximate said open central region on opposite sides of said open central region.

16. The assembly according to claim 15, wherein said first elastic loop bends about said first post structure and said second elastic loop bends about said second post structure.

* * * * *